United States Patent [19]

Lake

[11] Patent Number: 4,651,666

[45] Date of Patent: Mar. 24, 1987

[54] MULTI-HULL SAILBOAT RIGHTER

[76] Inventor: John A. Lake, 76 Pinon Heights Rd., Sandia Park, N. Mex. 87047

[21] Appl. No.: 666,645

[22] Filed: Oct. 31, 1984

[51] Int. Cl.[4] ..... B63H 9/04

[52] U.S. Cl. ..... 114/39; 114/61; 114/121; 114/125

[58] Field of Search ..... 114/39.1, 54, 61, 90, 114/94, 102, 103, 121-126; 441/93, 94, 96

[56] References Cited

U.S. PATENT DOCUMENTS

| | | | |
|---|---|---|---|
| 3,464,379 | 9/1969 | Lawson | 114/102 |
| 3,547,165 | 12/1970 | Butterworth | 441/93 |
| 3,782,413 | 1/1974 | Chacko | 441/96 |
| 3,865,061 | 2/1975 | Newman | 114/61 |
| 4,117,795 | 10/1978 | Ruiz | 114/39 |
| 4,441,445 | 4/1984 | DeWeck | 114/39 |
| 4,516,516 | 5/1985 | Methven | 114/121 |
| 4,516,518 | 5/1985 | Cate | 114/39 |

FOREIGN PATENT DOCUMENTS

| | | | |
|---|---|---|---|
| 2755991 | 6/1979 | Fed. Rep. of Germany | 114/39.1 |
| 3004780 | 8/1981 | Fed. Rep. of Germany | 114/39.2 |
| 1323969 | 11/1963 | France | 114/123 |
| 2515135 | 4/1983 | France | 114/123 |
| 2518955 | 7/1983 | France | 114/123 |
| 835878 | 6/1981 | U.S.S.R. | 114/121 |

*Primary Examiner*—Sherman D. Basinger

*Assistant Examiner*—Stephen P. Avila

*Attorney, Agent, or Firm*—Rodey, Dickason, Sloan, Akin & Robb

[57] ABSTRACT

The invention is a water lifter for use on knocked down multi-hull sailboats. The water lifter comprises a water bucket attached to one or more bucket lines which in turn are attached to one or more down pulleys. The down pulleys are in turn connected by pulley ropes to one or more top pulleys to provide sufficient mechanical advantage for a small single person to lift the water bucket out of the water. The top pulleys are attached to the uppermost hull of the knocked down multi-hull craft. On small sailboats, a single small person then braces his feet against the down hull, and positions his back against the water bucket, and pushes the water bucket as far as he or she can from the down hull, using his or her strong leg and back muscles. The weight of the water in the water bucket, as much as 400 pounds or more, combined with the now extended moment arm provide the necessary torque to lift the mast of the knocked down sailboat out of the water and rotate the sailboat so that it will come to rest upright on all of its hulls, in quick, easy, and very safe manner. For larger multi-hull sailboats, a boom arrangement with a winch affixed at the base of the mast assists in lifting a larger water bucket with more water, thus a greater weight, a greater distance from the down hull, thus overcoming the weight of the heavier mast, sails and hulls.

20 Claims, 7 Drawing Figures

MULTI-HULL SAILBOAT RIGHTER

SUMMARY

Multiple hull sailboats such as catamarans and trimarans are capable of being blown over so that only one outer hull is in the water, along with the tip of the mast, a knock down. In some rather extreme situations the sailboats are turned completey upside down so that the mast is pointing down under the water. The upside down situation is commonly referred to as being turtled. In either a knocked down or a turtled situation, it is naturally desireable to be able to right the sailboat to its upright position as soon as practical, and to do so with a minimum of effort. It is therefore an objective of this invention to enable a small person such as a boy or young lady weighing a little as one hundred pounds to be able to right a sailboat unassisted. It is also an objective to keep any modification to a sailboat, already built, to an absolute minimum in order to minimize the cost of installing the invention. Keeping the weight of the accessories on any sailboat to a minimum is also desireable so that performance is not sacrificed. Consequently, it is an objective of the invention to minimize weight. Lastly, because the invention could add immensely to the safety aspects of sailing multi-hull sailboats, it is an objective of the invention that it be very simple, and operable with little or no instruction, and be within the economic means of all appropriate sailboat owners.

DESCRIPTION OF THE PRIOR ART

1. Field of the Invention

This invention relates generally to means for righting multiple hull sailboats, and more particularly to weight lifting means and mast flotation means for multi-hull sailboats.

2. Description of the Prior Art

There have been many schemes devised for righting a knocked down, or turtled multiple hull sailboat. This problem is rather unique with multi-hull sailboats, since the heavy weight of the keel on most mono-hull sailboats is generally sufficient to right a knocked down mono-hull sailboat. When a multiple hull sailboat is knocked down, the center of gravity of the sailboat is between the two hulls and tends to keep the sailboat knocked down. A commonly used device for righting small catamarans is called a Hawaiian Sling. This device comprises a rope arrangement that allows one or more persons to stand on the down hull and lean as far as practical in the direction tending to right the sailboat. On very popular sixteen foot catamarans, it is generally a tedious and strenuous task for two husky men to right the sailboat from a knocked down position with a Hawaiian Sling. Another device, developed by John Cate of Albuquerque, N.M., patent pending, is advertised to have a boom arrangement which can be attached to both the up hull and the down hull, on which as person can scramble outward thus giving the person's weight a longer moment arm through which to act, and accomplishing the task of righting the sailboat much faster, than using a Hawaiian Sling. For larger sailboats, and for trimarans which have turtled, most schemes at least in part employ a method of filling both outer hulls partially with water, flooding the bow end of the outer hulls, thus causing the bow to sink while the main hull keeps the sailboat afloat, and effecting a stern over bow righting roll over.

DESCRIPTION OF THE PREFERRED EMBODIMENT

Figure 1:
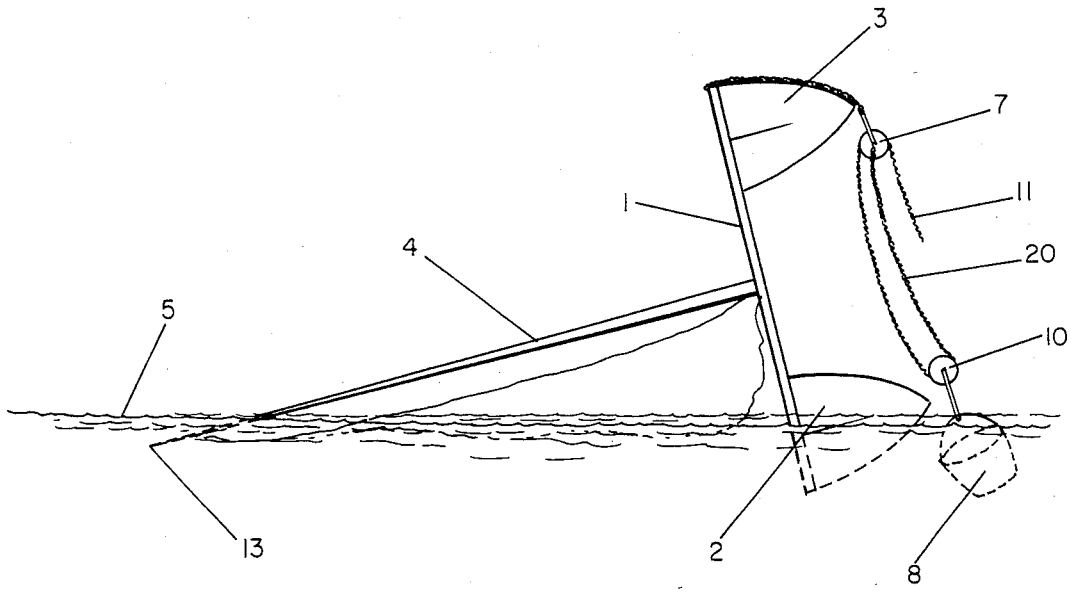
FIG. 1 is a schematic end view of a catamaran in a knocked down position.

FIG. 1 shows a catamaran 1 in the knocked down position. In this position, the catamaran 1 has a down hull 2 and an up hull 3, and a mast 4 whose tip 13 is lying at or near the surface 5 of the water. When the catamaran 1 is in this position, a person attempting to right the catamaran 1 stands on the down hull 2. A water lifter 20 comprising an an attachment means, shown as attachment line or lines 6, top pulley or pulleys 7, down pulley or pulleys 10, a water bucket 8, bucket lines 9, and a pulley rope or ropes 11, conveniently stored adjacent to the base of the mast 4, is connected to the sailboat. The attachment line or lines 6 are attached to the up hull 3, and a top pulley or pulleys 7 are fastened to the attachment line 6. The water bucket 8, having sufficient capacity, is attached to the bucket lines 9 and filled with water. The bucket lines 9 are attached to the down pulley or pulleys 10; and the pulley rope or ropes 11 are threaded between the top pulley or pulleys 7 and the down pulley or pulleys 10 and attached to either the up or down pulleys, 7 or 10, in a manner to create a mechanical advantage of two, three, or four to one, or more, depending on the size of the person and the size of the sailboat. Once assembed in the aforesaid manner, the person fills the water bucket 8 with water and lifts the water bucket 8 by pulling on pulley rope or ropes 11 until the water bucket 8 is virtually clear of the water surface 5; and then secures the pulley rope 11 so that the full water bucket 8 is retained in the highest position. On small sailboats, this may be sufficient to right the sailboat, but in most applications, such as a sixteen foot Hobie-Cat, it will not be. The person next braces his feet on the down hull 2, and positions his back against the water bucket 8 and pushes as hard as necessary, forcing the water bucket 8 away from the down hull 2. A practical size for a water bucket 8 would be one that will hold about four hundred pounds of water, or about six and a half cubic feet. With half this weight pushed four feet away from the down hull 2, a one hundred pound person can right a knocked down sixteen foot Hobie Cat in less than ten seconds. When a person uses his or her legs, they are using the strongest muscle groups of their body and can easily push the weight away from the down hull 2. A larger water bucket 8 and a greater mechanical advantage would be required of the pulleys 7 and 10 for larger sailboats. Even when a small sailboat is turtled, the lifting and pushing of the full water bucket 8 plus the weight of the person standing on the down hull 2 is sufficient to right the sailboat, because the water weight is acting outside of the down hull 2.

Figure 4:
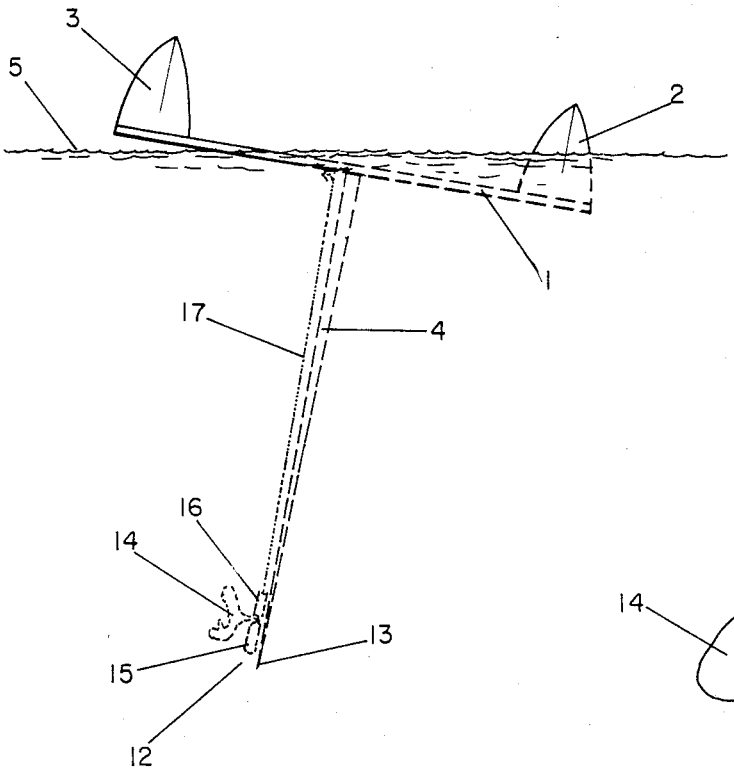
FIG. 4 is a schematic end view of a catamaran in the turtled position with the mast float actuated.
Figure 6:
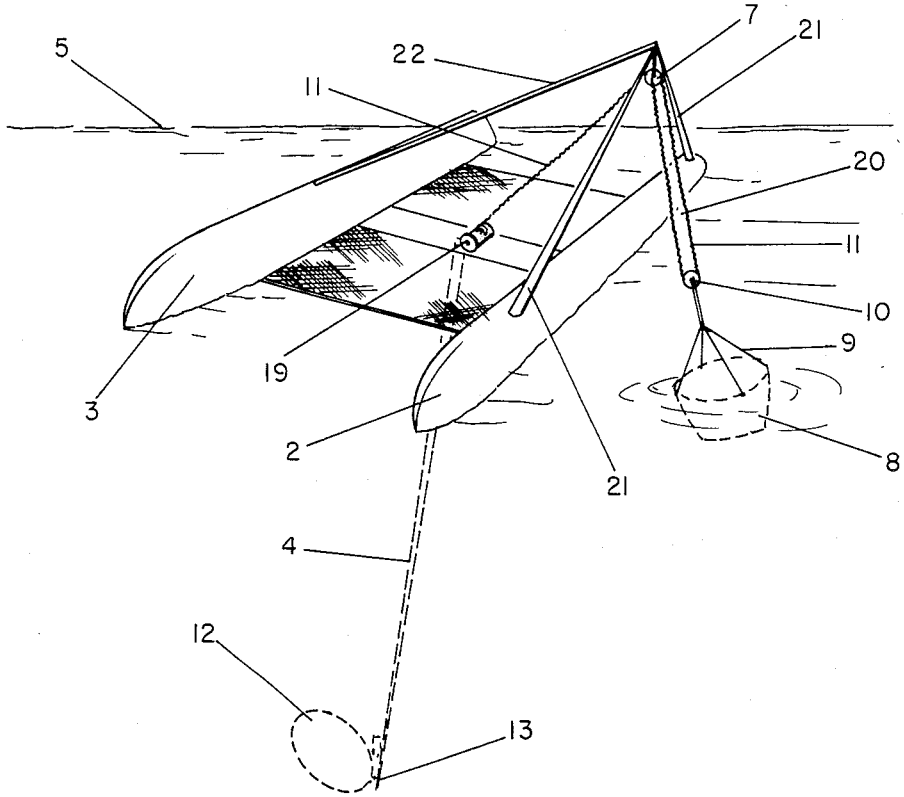
FIG. 6 is an isometric schematic of a turtled catamaran with a boom arrangement attached.
Figure 7:
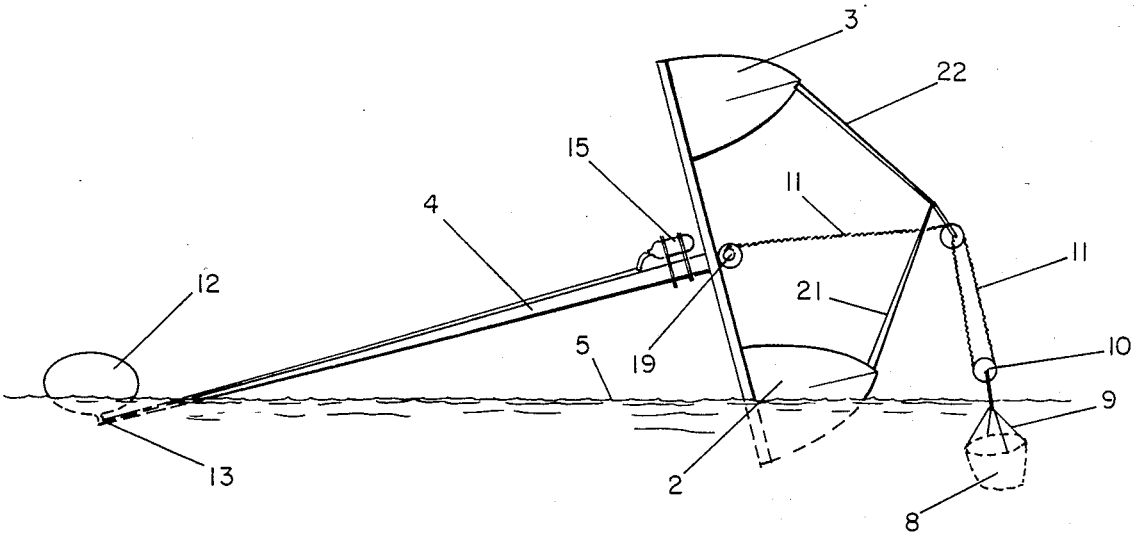
FIG. 7 is a schematic end view of a catamaran in the knocked down position with a boom arrangement attached.

On larger multi-hull sailboats, turtling is a very serious matter, and it often takes a shoreline and winch, and even divers, to right the turtled sailboat to the knocked down position. To assist in raising the mast 4 of a turtled sailboat, a mast float 12 is installed at the tip 13 of the mast 4. As shown in FIG. 4, the mast float 12 is a collapsed bag 14 connected to a compressed gas cylinder 15 which is in turn connected to an actuating means 16 which can be actuated from adjacent to the base of the mast 4. When turtled, a sailor uses the actuating means 16 to release the gas from the compressed gas cylinder 15 into the collapsed bag 14. The collapsed bag 14 expands and creates a bouyant force lifting upward on the tip 13 of the mast 4. The gas cylinder 15, if small for small sailboats, may be mounted at the tip of the mast 13 as shown in FIG. 4; but for larger sailboats the required gas cylinder may have too much mass and must therefore be mounted adjacent to the base of the mast 4 as shown in FIG. 7. Technically, in a turtled position the mast 4 is pointing straight down, and there is very little moment arm for the bouyant force to act through. To aid in raising the mast 4 to the surface 5, the person should stand on one of the outermost hulls, tipping the sailboat and mast 4 from the vertical position. As the tip 13 of the mast 4 begins to raise slowly, the moment arm increases and the mast 4 will raise faster until it reaches the surface 5. At this point, the person can use the water lifter 20 as previously described. On larger multi-hull sailboats the weight of a single person standing on one of the outer hulls of a turtled sailboat will be insufficient to significantly tip the sailboat and put the mast 4 off of the vertical. In order to significantly tip the large sailboat when in a turtled position and to aid in raising the mast tip 13 to the surface of the water 5, the water lifter 20 may be employed. To accomodate the turtled position and yet lift the water bucket 8 outside of one of the hulls, the attachment means must employ a boom arrangement 18 as shown in FIG. 7. The boom arrangement 18 must position the top pulley 7 of the water lifter 20 above the surface of the water 5 and outside of one of the outer hulls and it must support the top pulley 7 and the water lifted. It is obvious that a great many variations in the boom arrangement 18 and means for attaching the boom arrangement 18 to the hulls or other parts of the bottom of the boat are possible. A custom design to attach the boom arrangement 18 to the hull of some sailboats may be required. With rather standard materials such as aluminum a typical boom arrangement 18 may be made out of tubing and be easily assembled with bolts and nuts, or be pre-assembled ready to just unfold and attach. With more exotic materials such as chromium molybdenum steel tubing very little bracing would be required. With the larger sailboats, a larger water bucket 8 capable of holding more water would be required, and consequently the top and down pulleys, 7 and 10, may be connected by the pulley rope 11 in such a fashion to provide a mechanical advantage much higher, on the order of ten or more. And indeed, it may still be impractical for one person to lift all the required water unaided. On these larger sailboats, the the person lifting the water can be aided by a winch 19, manual or electric, standard or self-tailing, mounted under the sailboat adjacent to the base of the mast 4. The free end of the pulley rope 11 is passed through and around the winch 19 to actually do the laborious pulling instead of the person. As shown, the boom arrangement 18 is attached to both hulls. To right a large turtled sailboat, the sailor would first attach the boom arrangement 18 to the hulls, then attach the water lifter 20 to the boom arrangement 18 by affixing the top pulley 7 to the boom arrangement 18, and thread the pulley rope 11 from the top pulley 7 to the winch 19. The sailor would next activate the mast float 12, and operate the winch 19. When the mast tip 13 reaches the surface of the water 5, the sailor would disconnect the water lifter 20 and the boom arrangement 18. For very large sailboats the boom arrangement 18 can be reattached as shown in FIG. 6. In this configuration the boom arrangement 18 provides a longer moment arm through which the water lifter 20, when attached, will act causing the sailboat to rotate from the knocked down position to the upright position. In this configuration the boom arrangement 18 becomes the attaching means for attaching the top pulley 7 to the up hull 3. The boom arrangement 18 is shown to be a tripod type, with two legs 21 and an arm 22. The arm 22 is adjustable in length by having telescoping sections. When attached to a turtled sailboat, the arm 22 and legs 21 are of such length that when a load is applied by raising the water bucket 8 the legs 21 are in compression and the arm 22 is in tension. When using the boom arrangement 18 on a sailboat in the knocked down position, the arm 22 is attached to the up hull 3 while the legs 21 are attached to the down hull 2. The boom arrangement 18 shown is typical, and not intended to be limiting, as there are many variations which may be used as well.

Because the mast 4 is substantially below the surface 5 when the sailboat is turtled, the pressure differential from the surface down to the turtled mast tip 13 is large. For this reason the collapsed bag 14 should be of a material which is relatively non-elastic. The compressed gas cylinder 15 may be of any type that are commonly available, and such may contain carbon dioxide, air, or oxygen.

For ease of storage, it is desirable that the water lifter 20 be made of material which is collapsible, in as much as is possible. For example, the water bucket 8 can be made of canvas, or neoprene, or any rather heavy rip resistant material that may be conveniently folded. The pulley ropes 11 may be made of commonly used nylon or the equivalent. Of course if storage ability is of secondary consideration, rigid or semi-rigid material will also function satisfactorily.

The size of the collapsed bag 14 when inflated by the compressed gas released from the compressed gas cylinder 15 will be a function of the size and configuration of the sailboat. This will also determine how much gas must be stored in the compressed gas cylinder 15. The actuating means 16 may be of any commonly used means currently used such as a valve or piercing means, and a lanyard 17 from the actuating means 16 to the base of the mast 4.

Figure 2:
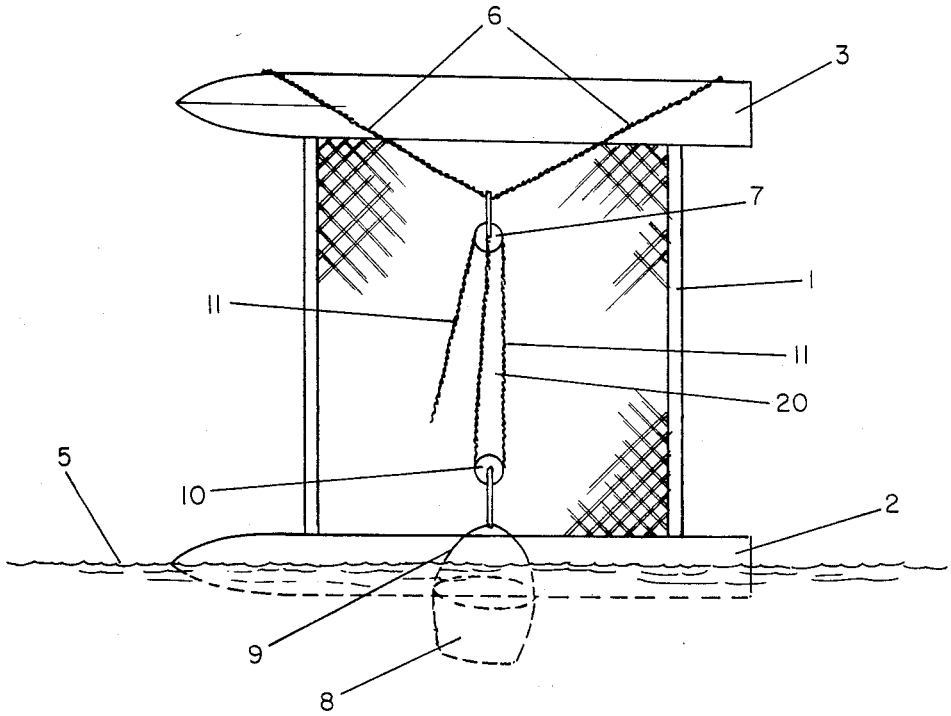
FIG. 2 is a schematic bottom view of a catamaran in a knocked down position with a single pulley arrangement of the water lifter.
Figure 3:
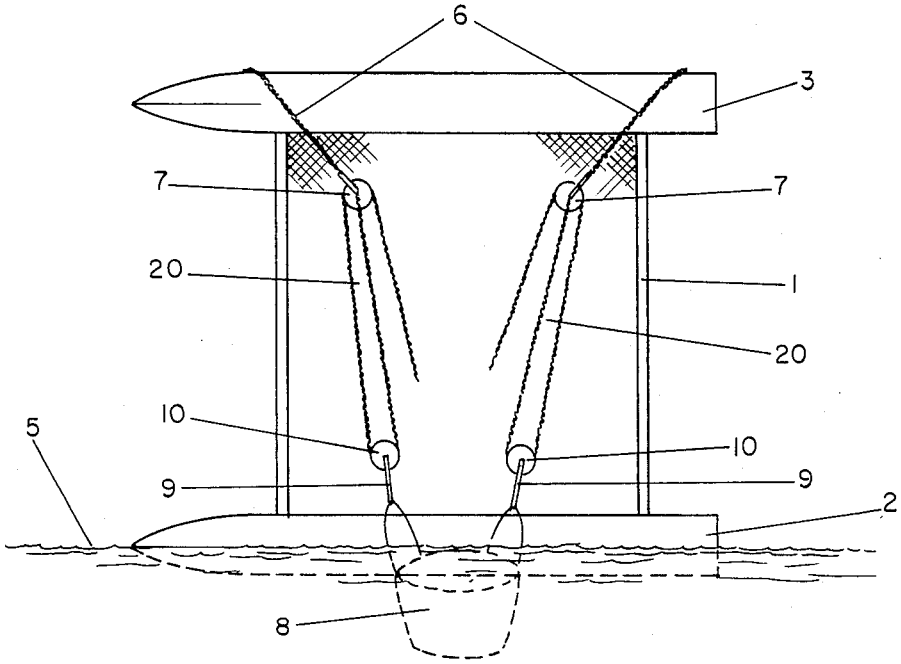
FIG. 3 is a schematic bottom view of a catamaran in a knocked down position with a double pulley arrangement of the water lifter.

FIG. 2 shows a configuration of the water lifter 20 wherein the attachment means is an attachment line 6 affixed at two points to the up hull 3, and the single top pulley 7 is attached to the attachment line 6. The attachment means may be any convenient manner of attaching the top pulleys 7 to the up hull 3, even such as a direct attachment to a fixture on the top hull. A single down pulley 10 is attached to the water bucket 8 by a plurality of bucket lines 9 and the pulley rope 11 is attached to either the top pulley 7 or down pulley 10 and threaded through the top pulley 7 and the down pulley 10, providing the desired mechanical advantage. FIG. 3 shows two attachment lines 6 affixed to the up hull 3 and a top pulley 7 attached to each of the attachment lines 6. The water bucket 8 is shown to be attached by bucket lines 9 to each down pulley 10; and a separate pulley rope 11 is threaded between each of top pulley 7 and down pulley 10 pairs. In this configuration, the person righting the sailboat must alternately pull on first one pulley rope 11 and then the other pulley rope 11; and the use of fiddle blocks rather than standard pulleys in the top pulleys 7 and down pulleys 10 will facilitate rope control.

Figure 5:
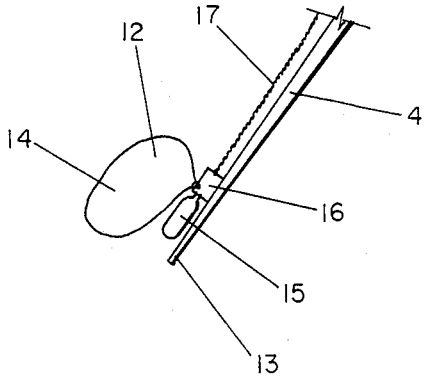
FIG. 5 is an isolated schematic viw of the mast tip and actuated mast float attached thereto, of a turtled catamaran.

FIGS. 4 and 5 show the sailboat in a turtled position, with the collapsed bag 14 having been inflated by compressed gas which has been released from the compressed gas cylinder 15 by the actuating means 16 which is depicted as a lanyard 17. As shown in FIGS. 4 and 5, the mast 4 has started to rise to the surface, and the mast float 12 will continue to raise the mast tip 13 to the surface. After the mast tip 13 reaches the surface, the water lifter 20 will be employed to complete the righting of the sailboat.

I claim:

1. A device for righting a multi-hull sailboat which has been knocked down thereby having an up hull and down hull, said device comprising:

(a) at least one pulley system, said pulley system comprising a top pulley and a down pulley as a pulley pair, and a pulley rope threaded through said down pulley and top pulley of said pulley pair with the end of said pulley rope extending from one of said pulleys in said pulley pair to create a mechanical advantage for a person pulling on said pulley rope to raise a water bucket full of water;

(b) at least one attachment line which is connected to said up hull structure, wherein said line attaches to said top pulley;

(c) a clasp for attaching said top pulley to said attachment line;

(d) a water bucket, said water bucket containing an opening for allowing water to enter the bucket;

(e) bucket lines to attach said water bucket to said down pulley; and (f) a clasp for attaching said down pulley to said bucket lines;

wherein during operation of the righting device, the top pulley is attached to said attachment line by a clasp, said water bucket is attached to said bucket lines, said bucket lines are attached to said down pulley by a clasp, said water bucket is then filled with water, said pulley rope extending from one of said pulleys of said pulley pair is pulled by a person, said water bucket is thereby raised and the sailboat is righted.

2. A righting device in accordance with claim 1 wherein said pulley rope extends from the top pulley of the pulley pair.

3. A righting device in accordance with claim 1 wherein said water bucket is sized to hold approximately four hundred pounds of water.

4. A righting device in accordance with claim 1 wherein there is only one attachment line and one pulley pair.

5. A righting device in accordance with claim 1 wherein there are two attachment lines and two pulley pairs, and wherein the top of each of said pulley pairs is attached to a different attachment line, and wherein the down pulleys of each of said pulley pairs is attached to said water bucket by bucket lines and clasps.

6. A righting device in accordance with claim 1 further comprising a mast float system, said mast float system comprising:

a collapsed bag, a cylinder of compressed gas, and an actuating means, and wherein the collapsed bag is affixed to a tip of a mast on the multi-hull sailboat, and is connected to said compressed gas cylinder, and wherein said compressed gas cylinder is connected to said actuating means, and wherein said actuating means is secured to the base of the mast, and wherein when said actuating means is activated, the compressed gas in the compressed gas cylinder is released into the collapsed bag, thereby inflating the collapsed bag and creating a buoyant force at the tip of the mast.

7. A device for righting a multi-hull sailboat which has been knocked down or turtled, said device comprising:

(a) a pulley system, said pulley system comprising a top pulley and a down pulley as a pulley pair, and a pulley rope threaded through said down pulley and top pulley of said pulley pair with the end of said pulley rope extending from said top pulley to create a mechanical advantage for a person pulling on said pulley rope to raise a water bucket full of water;

(b) a boom arrangement which attaches to the underside of the sailboat and to said top pulley of said pulley system;

(c) a clasp for attaching said top pulley to said boom arrangement;

(d) a water bucket, said water bucket containing an opening for allowing water to enter the bucket;

(e) a bucket line to attach said water bucket to said down pulley; and (f) a clasp for attaching said down pulley to said bucket line;

wherein during operation of the righting device, said boom arrangement is attached to the underside of the sailboat, the top pulley of said pulley pair is attached to said boom arrangement by a clasp, said water bucket is attached to said bucket line, said bucket line is attached to said down pulley by a clasp, said water bucket is then filled with water, said pulley rope extending from said top pulley is pulled by a person, and said water bucket is thereby raised and the sailboat is righted.

8. A righting device in accordance with claim 7 wherein said boom arrangement comprises an arm which is adjustable in length and two legs.

9. A righting device in accordance with claim 7 wherein said boom arrangement attaches to the hull structure of the multi-hull sailboat.

10. A righting device in accordance with claim 7 further comprising a mast float system, said mast float system comprising:

a collapsed bag, a cylinder of compressed gas, and an actuating means, and wherein the collapsed bag is affixed to a tip of a mast on the multi-hull sailboat, and is connected to said compressed gas cylinder, and wherein said compressed gas cylinder is connected to said actuating means, and wherein said actuating means is secured to the base of the mast, and wherein when said actuating means is activated, the compressed gas in the compressed gas cylinder is released into the collapsed bag, thereby inflating the collapsed bag and creating a buoyant force at the tip of the mast.

11. A righting device in accordance with claim 10 wherein the compressed gas in said compressed gas cylinder is carbon dioxide.

12. A righting device in accordance with claim 10 wherein the compressed gas in said compressed gas cylinder is oxygen.

13. A righting device in accordance with claim 10 wherein the compressed gas in said compressed gas cylinder is air.

14. A righting device in accordance with claim 10 wherein said actuating means is a lanyard connected to a piercing mechanism which pierces the compressed gas cylinder and wherein said lanyard is secured at the base of the mast.

15. A righting device in accordance with claim 10 wherein said actuating means is a lanyard connected to a release valve, said release valve being between the compressed gas cylinder and the collapsed bag, and wherein the lanyard is secured at the base of the mast.

16. A righting device in accordance with claim 10 wherein said compressed gas cylinder is small and mounted at the top of the mast.

17. A righting device in accordance with claim 10 wherein said gas cylinder and said actuating means are mounted adjacent to the base of the mast.

18. A righting device in accordance with claim 7 further comprising a winch which is attached to the underside of the sailboat, wherein the end of said pulley rope which extends from said top pulley is attached to and pulled by the winch during operation;

wherein during operation of the righting device, said boom arrangement is attached to the underside of the sailboat, the top pulley of said pulley pair is attached to said boom arrangement by a clasp, the end of the pulley rope extending from said top pulley is attached to said winch, said water bucket is attached to said bucket line, said bucket line is attached to said down pulley by a clasp, said water bucket is then filled with water, and the winch is activated thereby raising the water bucket and righting the sailboat.

19. A righting device in accordance with claim 10 further comprising a mast float system, said mast float system comprising:

a collapsed bag, a cylinder of compressed gas, and an actuating means, and wherein the collapsed bag is affixed to a tip of a mast on the multi-hull sailboat, and is connected to said compressed gas cylinder, and wherein said compressed gas cylinder is connected to said actuating means, and wherein said actuating means is secured to the base of the mast, and wherein when said actuating means is activated, the compressed gas in the compressed gas cylinder is released into the collapsed bag, thereby inflating the collapsed bag and creating a buoyant force at the tip of the mast.

20. A device for righting a multi-hull sailboat which has been knocked down thereby having an up hull and a down hull, said device comprising:

(a) a pulley system, said pulley system comprising a top pulley and a down pulley as a pulley pair, and a pulley rope threaded through said down pulley and top pulley of said pulley pair with the end of said pulley rope extending from said top pulley to create a mechanical advantage for a person pulling on said pulley rope to raise a water bucket full of water;

(b) an attachment line which is connected to said up hull structure, wherein said line attaches to said top pulley;

(c) a clasp for attaching said top pulley to said attachment line;

(d) a water bucket, said water bucket containing an opening for allowing water to enter the bucket;

(e) a bucket line to attach said water bucket to said down pulley;

(f) a clasp for attaching said down pulley to said bucket line;

(g) a winch which is attached to the underside of the sailboat, wherein the end of said pulley rope which extends from said top pulley is attached to and pulled by the winch during operation; and (h) a mast float system, said mast float system comprising:

a collapsed bag, a cylinder of compressed gas, and an actuating means, and wherein the collapsed bag is affixed to a tip of a mast on the multi-hull sailboat, and is connected to said compressed gas cylinder, and wherein said compressed gas cylinder is connected to said actuating means, and wherein said actuating means is secured to the base of the mast, and wherein during operation of the righting device said mast float system actuating means is activated, the compressed gas in the compressed gas cylinder is released into the collapsed bag, thereby inflating the collapsed bag and creating a buoyant force at the tip of the mast, the top pulley is attached to said attachment line by a clasp, said water bucket is attached to said bucket line, said bucket line is attached to said down pulley by a clasp, said water bucket is then filled with water, said pulley rope extending from said top pulley is attached to said winch, and the winch is activated thereby raising the water bucket and righting the sailboat.

* * * * *

UNITED STATES PATENT AND TRADEMARK OFFICE

CERTIFICATE OF CORRECTION

PATENT NO. : 4,651,666

DATED : March 24, 1987

INVENTOR(S) : JOHN A. LAKE

It is certified that error appears in the above-identified patent and that said Letters Patent are hereby corrected as shown below:

In Claim 19, Column 7, 51 of the Patent, change "10" to --18--.

Signed and Sealed this

Eighth Day of March, 1988

*Attest:*

DONALD J. QUIGG

*Attesting Officer*

*Commissioner of Patents and Trademarks*